United States Patent [19]

Shieh

[11] Patent Number: 4,986,365

[45] Date of Patent: Jan. 22, 1991

[54] AUTOMATIC FIRE EXTINGUISHER SYSTEM FOR A VEHICLE

[76] Inventor: Kuo-Chen Shieh, No. 10, Alley 1, Lane 92, Kuangchow Street, Taipei, Taiwan

[21] Appl. No.: 328,865

[22] Filed: Mar. 27, 1989

[51] Int. Cl.[5] ..... A62C 35/12

[52] U.S. Cl. ..... 169/60; 169/62

[58] Field of Search ..... 169/56, 62, 19, 60

[56] References Cited

U.S. PATENT DOCUMENTS

| | | | |
|---|---|---|---|
| 2,511,959 | 6/1950 | Williams | 169/62 |
| 2,841,228 | 7/1958 | Porterfield | 169/62 |
| 3,387,662 | 6/1968 | Molgano | 169/62 |
| 3,754,602 | 8/1973 | Magdars | 169/62 |
| 4,265,316 | 5/1981 | Fee | 169/62 |
| 4,383,579 | 5/1983 | Monk | 169/62 |

*Primary Examiner*—Sherman Basinger
*Assistant Examiner*—Stephen P. Avila
*Attorney, Agent, or Firm*—Bacon & Thomas

[57] ABSTRACT

A fire in the engine compartment of a vehicle is automatically extinguished when an inertial force operated actuator ruptures a valve in the event of a vehicle collision to release pressurized chemical fire extinguishing gas into the compartment. The actuator may also be manually operated.

7 Claims, 6 Drawing Sheets

AUTOMATIC FIRE EXTINGUISHER SYSTEM FOR A VEHICLE

BACKGROUND OF THE INVENTION

Because of an enhanced quality of life in society today due to advancements in industry and commerce, there is a corresponding increase in living standards. This is evident in the acquisition of more cars by people, particularly expensive cars providing personal enjoyment. Since the number and types of cars are increasing, so are various kinds of vehicle accidents. An accident resulting in a fire to the vehicle is particularly troublesome and dangerous since there has heretofore been no suitable means to put out such a fire. Though portable fire extinguishers are known, they cannot adequately meet the necessary safety and practical performance standards desired by the user.

Problems involving vehicular fires and the extinguishing of such fires are many. For example, when a car is driven on the road, possible oil leaks from the carburetor may contact the high temperature engine and cause flame ignition. In order to extinguish the fire, the driver normally pulls off the road and opens the hood of the car. This poses a considerable risk to the driver since the temperature of the engine compartment is extremely high and the fire will burn more severely due to an increase in oxygen when the hood is opened, thereby rendering it more difficult to put out the fire with a conventional extinguisher. Also, the driver and passengers of a car may become physically disabled as a result of a collision, thereby preventing action to extinguish a fire caused by the collision. Accidents of this latter type often result in death of the vehicle occupants due to the presence of fire which cannot be extinguished. Finally, conventional fire extinguishers utilize a foam or dry powder material. Though these materials have excellent extinguishing capability for putting out car engine fires, they nevertheless adhere to the surfaces of the engine components and are expensive and time consuming to remove.

The present invention overcomes the problems and disadvantages associated with conventional methods and means for extinguishing vehicle fires by providing a unique and practical car fire extinguisher system which is both safe and automatic in use, and can be utilized to extinguish vehicle fires resulting from a variety of accidents and conditions.

SUMMARY OF THE INVENTION

It is an object of the invention to provide an improved fire extinguisher system for a vehicle wherein the system is automatic and safe in operation.

It is another object of the invention to provide an improved fire extinguisher system for the engine compartment of a vehicle which is capable of immediately extinguishing a fire therein notwithstanding the cause of the fire.

It is a further object of the invention to provide an improved fire extinguisher system for a vehicle wherein the system may be either automatically or manually operated to extinguish a fire in the vehicle.

It is yet another object of the invention to provide an improved fire extinguisher system for a vehicle which automatically extinguishes a fire with high pressure chemical gas that displaces ambient air in the engine compartment and put out any fire therein to protect the vehicle and its occupants.

It is still yet a further object of the invention to provide an improved fire extinguisher system for a vehicle whereby any fire in the engine compartment of the vehicle may be extinguished by the driver remaining within the car and without the necessity of opening the hood.

It is also an object of the invention to provide an improved fire extinguisher system for a vehicle wherein the system utilizes a fire extinguishing gas which will not affect the appearance of the engine compartment components or cause damage to same.

These and other objects of the invention are realized by providing a fire extinguisher system that includes a container filled with highly pressurized chemical fire extinguishing gas and provided with a hose that terminates in a rupturable gas nozzle positioned over a plate which also supports an impact member provided with a sharpened end for automatically rupturing the gas nozzle in the event of a vehicle collision. The impact member is associated with a weight member and provided with both a biasing spring and torquing spring for, respectively, controlling movement of the impact member and secure same in a fixed position after rupturing the gas nozzle. A handle may also be provided to permit manual actuation of the impact member.

Other objects, features and advantages of the invention shall become apparent from the following detailed description of preferred embodiments thereof, when taken in conjunction with the drawings wherein like reference characters refer to corresponding parts in the several views.

DETAILED DESCRIPTION OF THE PREFERRED EMBODIMENTS

Figure 1:
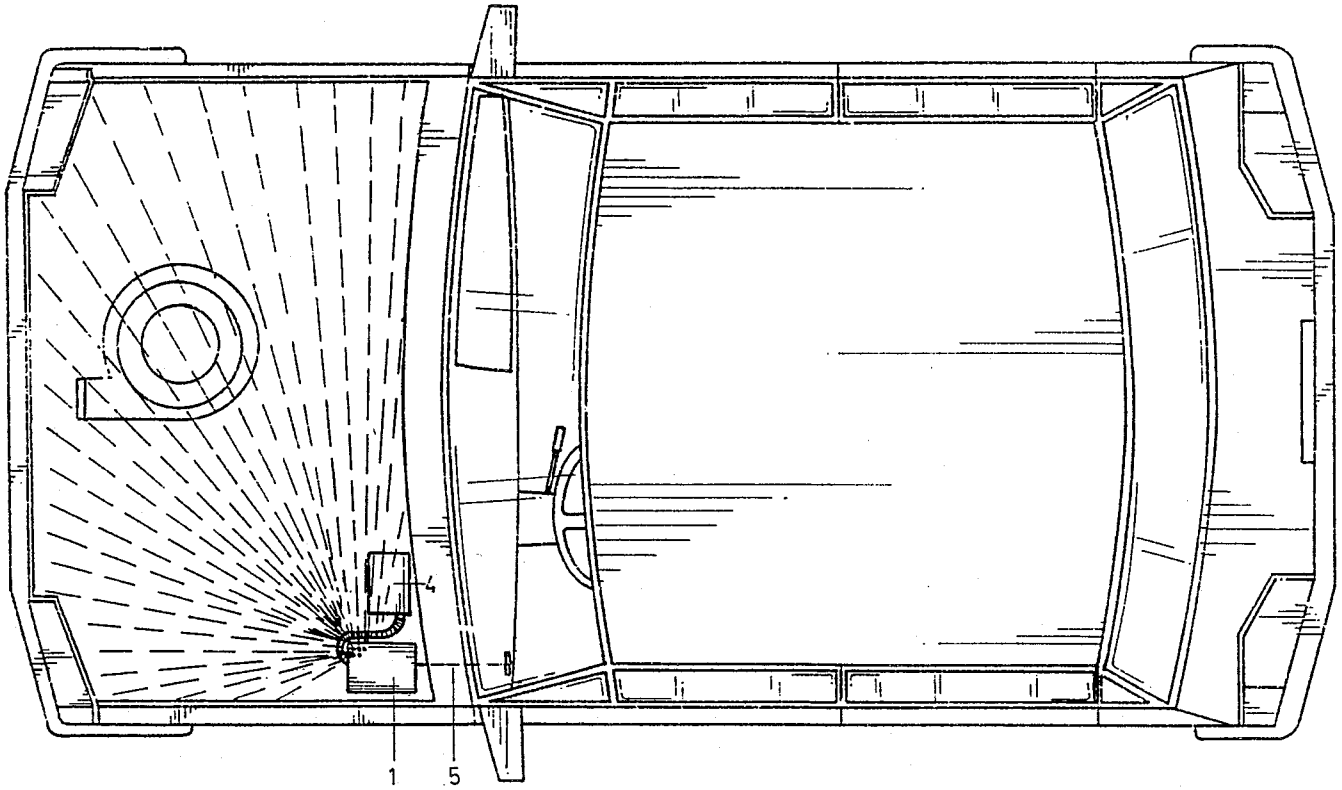
FIG. 1 is a top plan view, partly in section, showing a vehicle with a fire extinguisher system of the invention installed therein, and particularly depicting in dotted lines the dispersing of fire extinguishing gas in the engine compartment upon actuation of the system.
Figure 2:
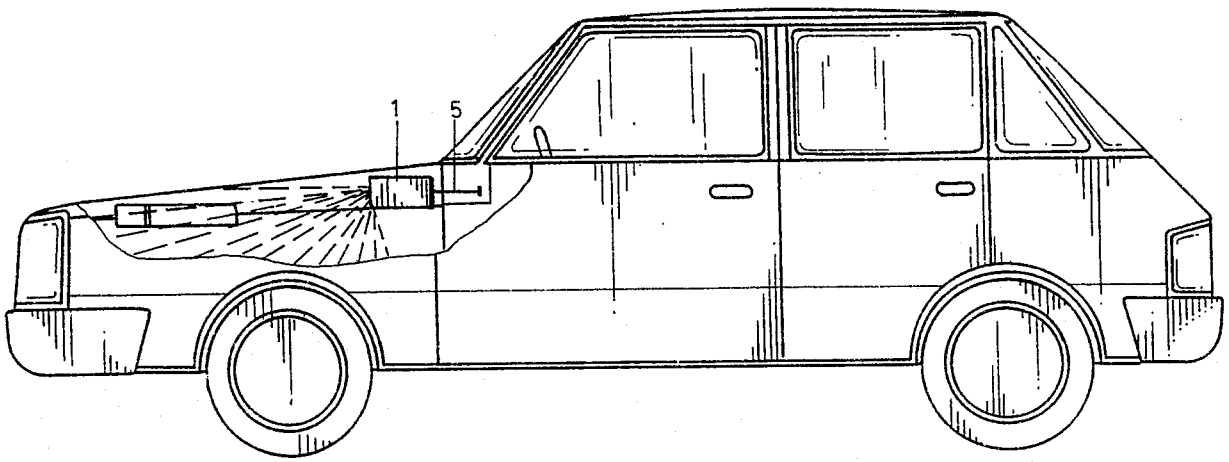
FIG. 2 is a front elevational view, partly in section, of the system shown in FIG. 1.

With initial reference to FIGS. 1 and 2, a fire extinguishing system according to the invention is shown installed within an engine compartment of a vehicle. The dotted lines depict fire extinguishing gas dispersed by the system into the engine compartment upon either manual or automatic actuation of the system.

Figure 3:
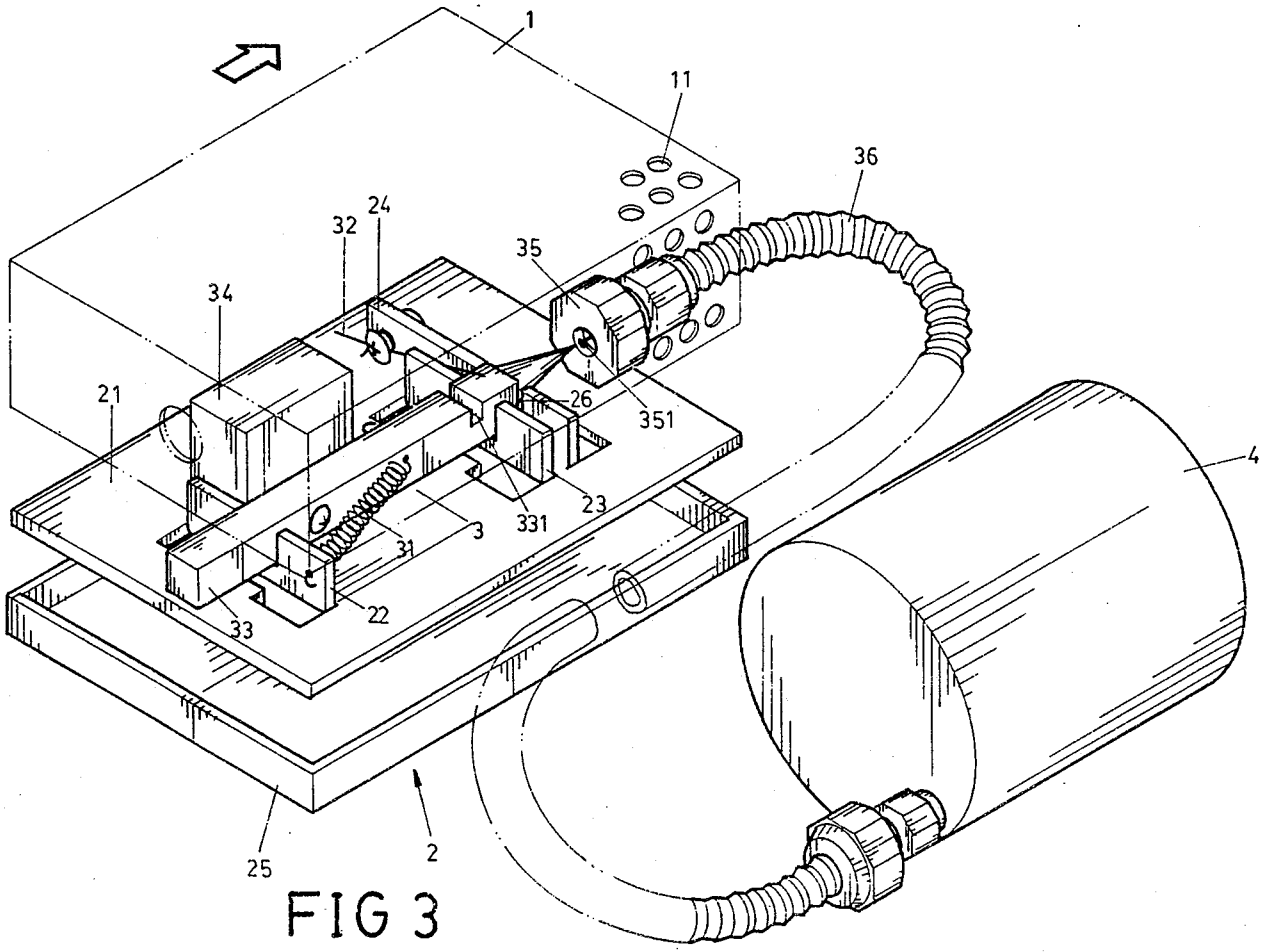
FIG. 3 is a partially exploded perspective view of a fire extinguisher system according to a first embodiment of the invention, wherein the system is depicted in a non-actuated condition.
Figure 4:
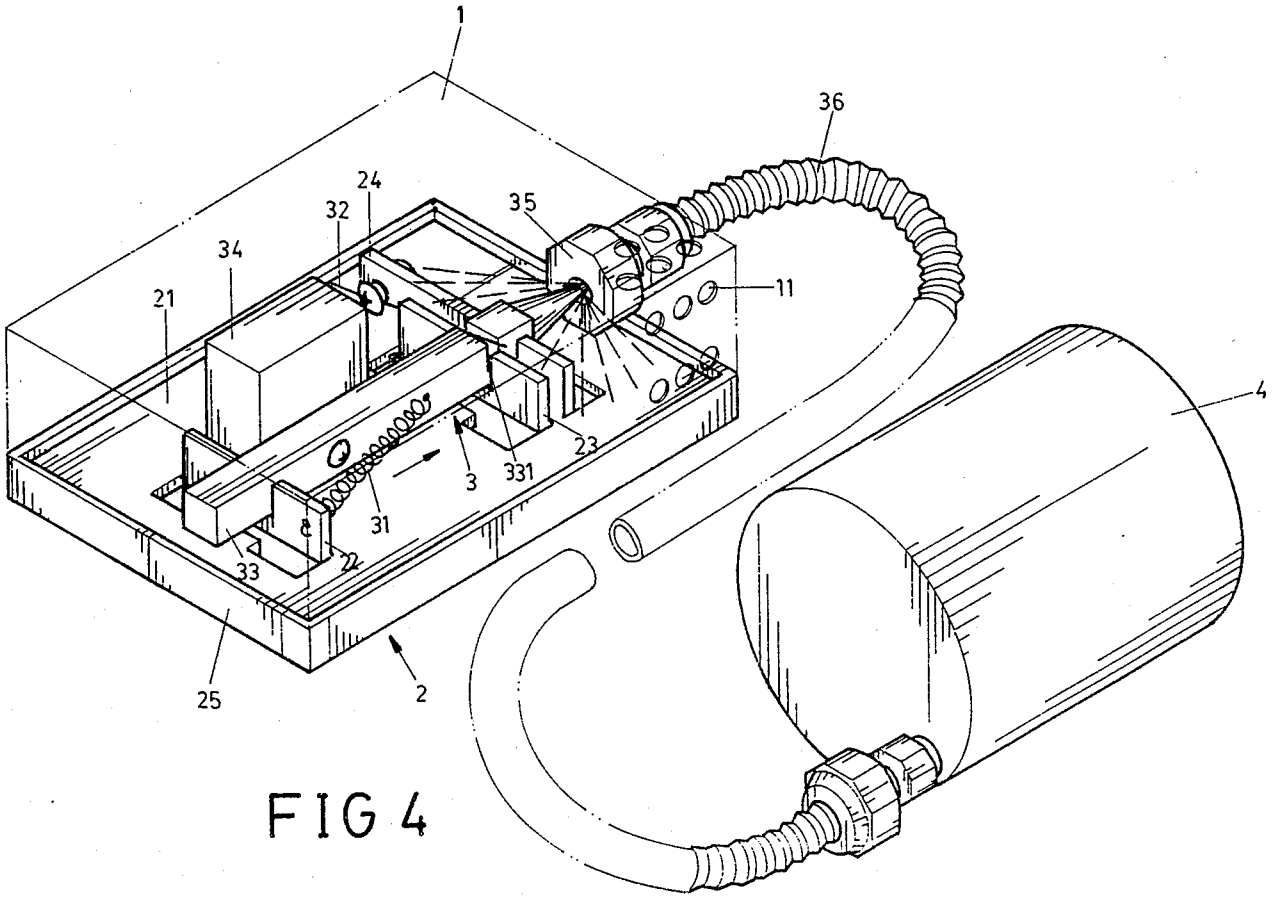
FIG. 4 is a perspective view of the system shown in FIG. 3, but depicted in an actuated condition wherein the impact member has ruptured the gas nozzle.

With further reference to FIGS. 3 and 4, there is shown a first embodiment of the system in a non-actuated condition and an actuated condition, respectively. The system includes a shell body 1 provided with a plurality of discharge holes 11 therein for diffusing high pressure chemical fire extinguishing gas from a pressurized bottle 4. A chassis 2 is composed of a bottom frame 25 and a bottom plate 21. A plurality of fixing tabs 22, 23 and 24 extend upwardly from bottom plate 21, with tabs 23 and 24 collectively defining an open groove 26. An elastic mechanism 3 is provided and includes a stretching spring 31 and a torquing spring 32. An impact member 33 is supported for sliding movement by fixing tabs 22, 23 and 24. A weight member 34 is secured to the side of impact member 33 by a screw. Stretching spring 31 has one end secured to tab 22 and another end secured to impact member 33. Torquing spring 32 has one end secured to tab 24 and another end disposed in engagement against impact member 33 adjacent a groove 331 formed in member 33 when the system is in the non-actuated condition shown in FIG. 3. Impact member 33 is provided with a forward end that terminates in a sharpened cone-shaped configuration which is positioned adjacent a rupturable gas nozzle 35 provided on the terminal end of a hose 36 which has its other end connected to pressurized bottle 4 for conveying gas therefrom to nozzle 35.

Stretching spring 31 functions as a safety control device, with the spring loading value thereof being predetermined to prevent impact member 33 from moving in the event of minor collisions. Gas nozzle 3 is provided with a rupturable check valve 351 and is installed on bottom plate 21, with check valve 351 facing the sharpened end of impact member 33. Thus, check valve 351 serves to control the discharge of high pressure chemical fire extinguishing gas from pressurized bottle 4, the latter being installed at a suitable position within the engine compartment of the vehicle so that gas contained therein is directed to gas nozzle 35 through hose 36.

When the vehicle is driven at a high speed, for example approximately 80 km/hr, in the direction indicated by the arrow in FIG. 3, and experiences a collision, weight member 34 is caused to be moved forward by inertial force, thereby also moving attached impact member 33 forward simultaneously. This causes the sharpened end of impact member 33 to rupture check valve 351 in gas nozzle 35, as shown in FIG. 4. When this occurs, the free end of torquing spring 32 is disposed into groove 331 to secure impact member 33 in a fixed position. The rupturing of check valve 351 causes the highly pressurized chemical fire extinguishing gas contained in bottle 4 to be discharged through hose 36 and out gas nozzle 35 into shell body 1. The gas thereafter diffuses through discharge holes 11 of body 1 into the engine compartment of the vehicle, thereby immediately extinguishing any fire contained therein. Check valve 351 may in the form of a rupturable disc of the type utilized in the pressurized bottle of a conventional dry powder fire extinguisher, thereby further assuring virtually complete discharge of fire extinguishing gas when check valve 351 is ruptured.

Since a gas extinguisher is utilized in the practice of the invention, it is not necessary to clean or repair the engine components after actuation of the system. It is only necessary to open the hood for air ventilation after the temperature of the engine is sufficiently lowered, and thereafter replace any components damaged by the fire. After such ventilation and replacement of components, the driver may restart the engine for continued operation. The system of the invention is therefore economical and practical, and also minimizes the expenditure of time and effort in its utilization.

Figure 5:
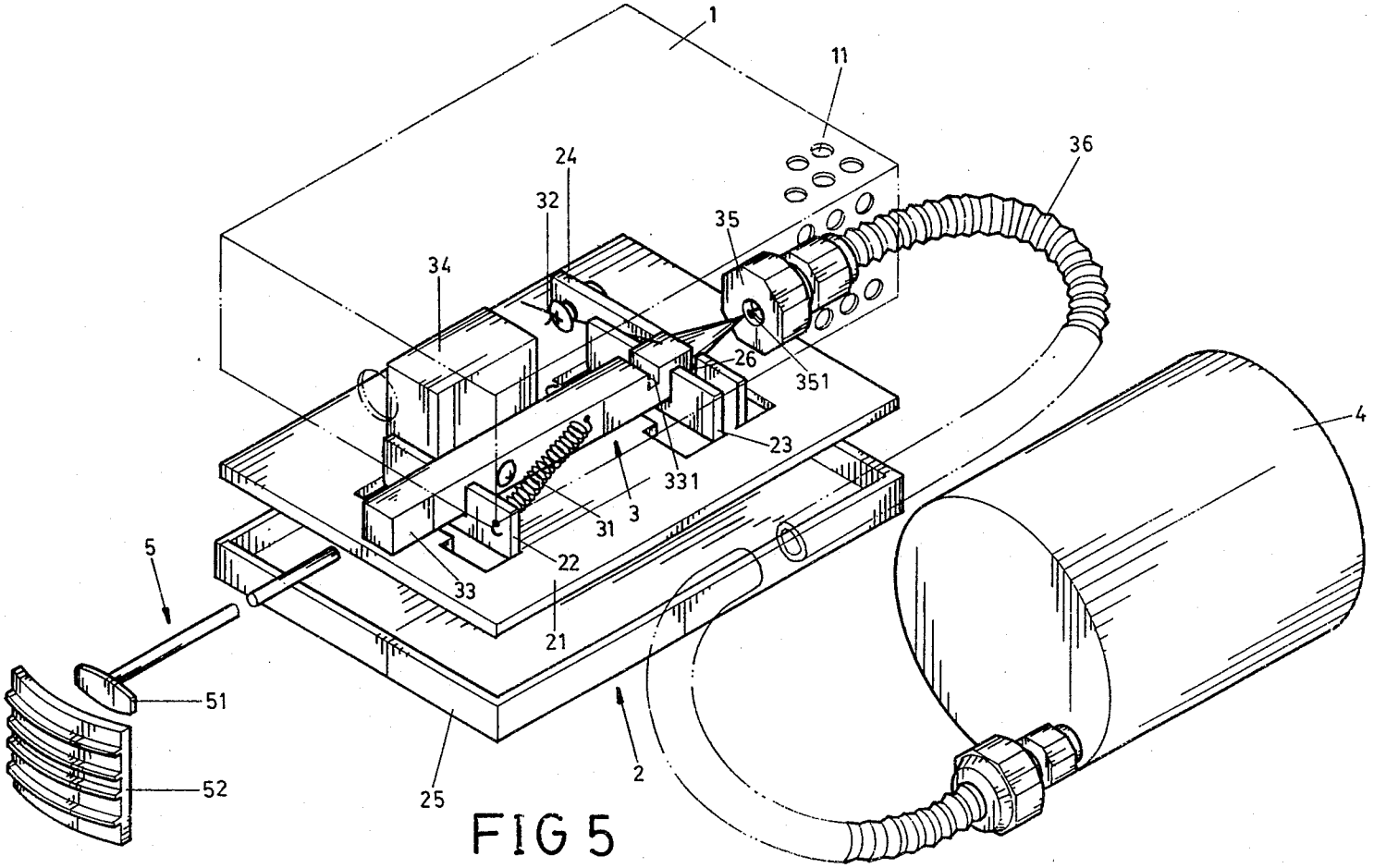
FIG. 5 is a partially exploded perspective view of a fire extinguisher system according to a second embodiment of the invention, wherein the system is depicted in a non-actuated condition.
Figure 6:
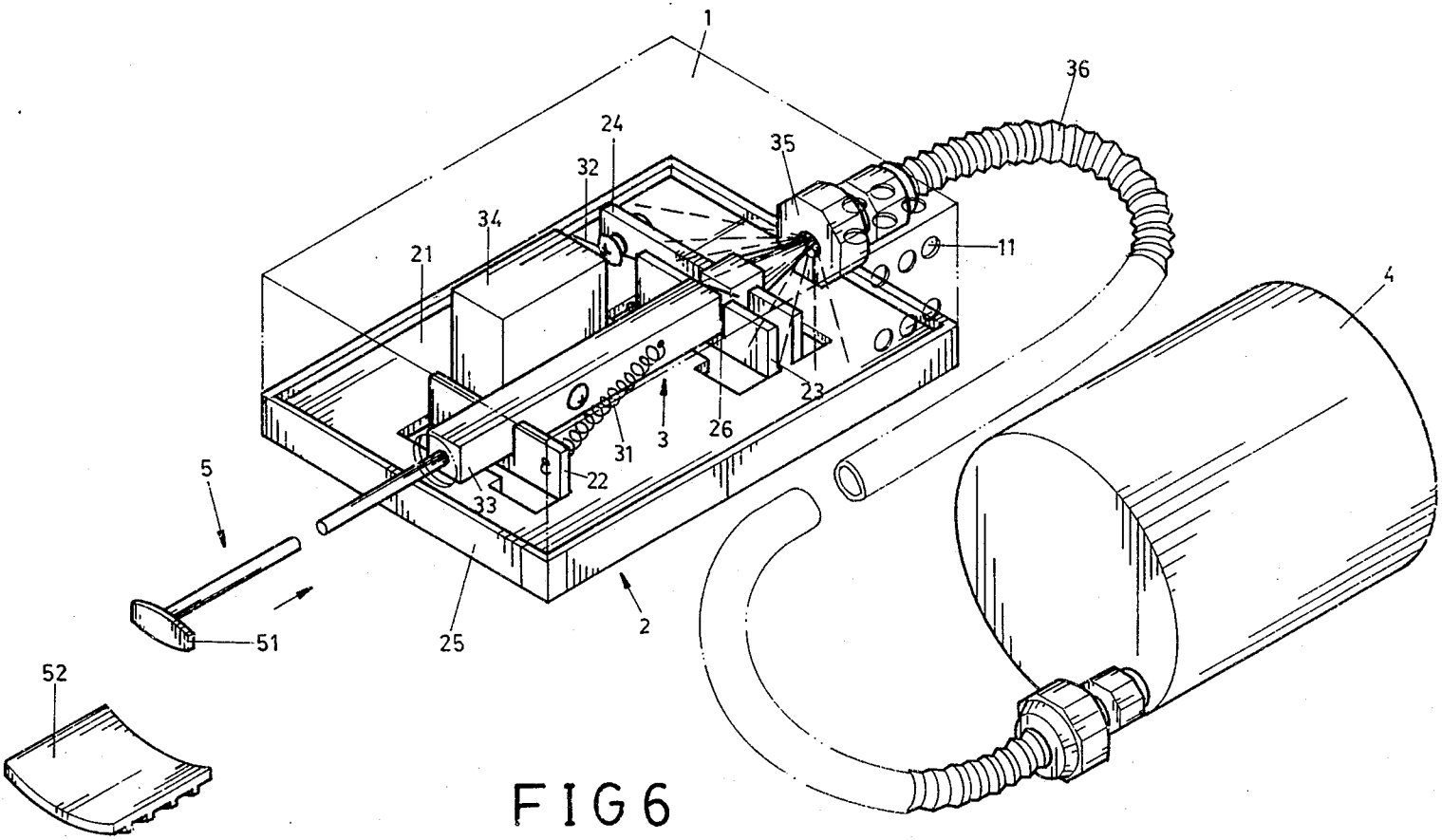
FIG. 6 is a perspective view of the system shown in FIG. 5, but depicted in an actuated condition wherein the impact member has ruptured the gas nozzle.

A second embodiment of the invention is shown in FIGS. 5 and 6 which depict the system in a nonactuated condition and an actuated condition, respectively. As shown therein, this embodiment is provided with a manual operation mechanism 5 which is installed between the vehicle body and impact member 33 at the rear of shell body 1. Mechanism 5 includes a rod provided with a handle 51 at its rear end and a protective cover 52. When cover 52 is removed, access to handle 51 is permitted for the purpose of manually pushing impact member 33 in a forward direction to rupture check valve 351, as shown in FIG. 6. In this way, the system can be actuated in the absence of a collision to extinguish a fire resulting from another cause.

I claim:

1. An automatic fire extinguisher system for a vehicle comprising:

(a) a contained source of pressurized fire extinguishing material;

(b) a rupturable valve means for controlling the discharge of the extinguishing material from the contained source thereof;

(c) inertial force operated actuating means for rupturing the valve means to discharge the extinguishing material in the event of vehicle collision, the actuating means including a slidable impact member provided with a sharpened end for rupturing the valve means;

(d) a bottom plate, a plurality of tabs extending upwardly from the bottom plate for slidably supporting the impact member, and a weight member connected to the impact member; and (e) a first elastic means connecting a first tab to the impact member for permitting the sliding movement thereof only when a predetermined inertial force is realized, the second elastic means connected to a second tab and disposed in engagement with the impact member to secure same in a fixed position after the impact member has ruptured the valve means.

2. The fire extinguisher system of claim 1 further including a perforated shell body enclosing the valve means and the actuating means so that the extinguishing material discharged from the ruptured valve means is caused to diffuse outwardly through the perforations of the shell body.

3. The fire extinguisher system of claim 1 further including a bottle for containing the extinguishing material and a hose connecting the bottle to the valve means for conducting the extinguishing material from the bottle to the valve means.

4. The fire extinguisher system of claim 1 further including means for manually operating the actuating means in the absence of inertial force.

5. The fire extinguisher system of claim 4 wherein the manual operating means includes a rod having one end connected to the actuating means and a handle provided at another end.

6. The fire extinguisher system of claim 5 further including a protective cover means enclosing the handle.

7. The fire extinguisher system of claim 1 wherein the extinguishing material is a highly pressurized chemical fire extinguishing gas.

* * * * *